US011518166B2

(12) United States Patent
Kitayama et al.

(10) Patent No.: US 11,518,166 B2
(45) Date of Patent: Dec. 6, 2022

(54) LIQUID EJECTION HEAD AND METHOD OF MANUFACTURING LIQUID EJECTION HEAD

(71) Applicant: CANON KABUSHIKI KAISHA, Tokyo (JP)

(72) Inventors: Yasuaki Kitayama, Yokohama (JP); Kyosuke Toda, Kawasaki (JP); Tatsunori Fujii, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/820,426

(22) Filed: Mar. 16, 2020

(65) Prior Publication Data

US 2020/0307194 A1 Oct. 1, 2020

(30) Foreign Application Priority Data

Mar. 29, 2019 (JP) ..... JP2019-068043

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1623* (2013.01); *B41J 2002/14491* (2013.01)

(58) Field of Classification Search
CPC ..... B41J 2/1433; B41J 2/162; B41J 2/1623
See application file for complete search history.

(56) References Cited

U.S. PATENT DOCUMENTS

2007/0285469 A1* 12/2007 Sato ..... B41J 2/1603 347/63
2008/0259125 A1* 10/2008 Haluzak ..... B41J 2/1637 347/50
2018/0079209 A1* 3/2018 Matsuo ..... B41J 2/1433
2018/0170050 A1* 6/2018 Chen ..... B41J 2/14145

FOREIGN PATENT DOCUMENTS

JP 2012-143896 A 8/2012

* cited by examiner

*Primary Examiner* — Jason S Uhlenhake
(74) *Attorney, Agent, or Firm* — Canon U.S.A., Inc. IP Division

(57) ABSTRACT

There is provided a method of manufacturing a liquid ejection head. The liquid ejection head includes a recording device substrate, an electric wiring member configured to be connected to the recording device substrate at an electric connection portion, and a support member including a concave portion and a convex portion. The convex portion includes a first surface and a second surface. The method includes applying an adhesive to the surface of the concave portion on which the recording device substrate is to be placed and to the first surface, pressing the applied adhesive after the recording device substrate is placed on the surface of the concave portion on which the recording device substrate is to be placed, to fill, with the adhesive, a gap between the convex portion and the recording device substrate to a position higher than the first surface, and sealing the electric connection portion.

12 Claims, 19 Drawing Sheets

A-A

B-B

C-C

A-A

B-B

C-C

A-A

B-B

C-C

A-A

B-B 9

C-C

A-A

B-B

C-C

A-A

B-B

C-C

A-A

B-B

C-C

A-A

B-B

C-C

A-A

B-B

C-C

A-A

B-B

C-C

B-B

B-B

B-B

B-B

B-B

B-B

B-B

B-B

B-B

LIQUID EJECTION HEAD AND METHOD OF MANUFACTURING LIQUID EJECTION HEAD

BACKGROUND OF THE DISCLOSURE

Field of the Disclosure

The present disclosure relates to a liquid ejection head ejecting liquid and a method of manufacturing the liquid ejection head.

Description of the Related Art

As a configuration of a liquid ejection head, a configuration that includes a recording device substrate to eject ink and a flexible board (electric wiring member) to supply an electric signal and power to the recording device substrate is well-known. The recording device substrate and the flexible board are electrically connected by an electric connection member protruding from the flexible board, such as an inner lead. Further, an electric connection portion of the recording device substrate and the flexible board is covered with and protected by a sealing material.

However, if the sealing material covering the electric connection portion comes into contact with a wide range of the recording device substrate and the sealing material is expanded or contracted by heat or the like, external force is applied to the recording device substrate, which may cause deformation of the recording device substrate.

Japanese Patent Application Laid-Open No. 2012-143896 discusses a configuration to prevent the sealing material from coming into contact with the wide range of the recording device substrate. More specifically, a convex portion protruding toward the recording device substrate is provided on a surface facing a concave portion provided in a support member supporting the recording device substrate. As a result, an adhesive applied to the support member to bond the recording device substrate and the support member flows between the recording device substrate and the convex portion by being pressed by the recording device substrate when the recording device substrate is bonded to the support member, and a wall portion by the adhesive is formed between the recording device substrate and the convex portion. When the wall portion is formed, it is possible to inhibit the sealing material covering the electric connection portion from extending toward a side surface of the recording device substrate, and to prevent the sealing material from coming into contact with the wide range of the recording device substrate.

In the configuration discussed in Japanese Patent Application Laid-Open No. 2012-143896, formation of the wall portion that can sufficiently prevent extension of the sealing material may be difficult depending on a composition of the adhesive and a configuration of the recording device substrate. For example, in a case where an adhesive with high thixotropy is used, an effect of forming the wall portion by capillary force is small in the adhesive with high thixotropy. Therefore, it is difficult to form the excellent wall portion. To form the wall portion even in such a case, it is necessary to apply the adhesive to the support member so as to be pilled up on the support member. The adhesive, however, is gradually dripped with a lapse of time. To maintain a shape of the pilled-up adhesive at a certain degree, it is necessary to apply the adhesive to a flat surface that serves as a support to prevent the adhesive from dripping. Accordingly, in the configuration discussed in Japanese Patent Application Laid-Open No. 2012-143896, it is necessary to apply the adhesive on a top surface of the convex portion, which may cause a state where the adhesive protrudes toward a side provided with a recording medium such as a sheet, of an ejection port surface provided with an ejection port of the recording device substrate. In such a state, a distance between the ejection port surface and the recording medium is increased, which may influence recording quality.

SUMMARY OF THE DISCLOSURE

According to an aspect of the present disclosure, there is provided a method of manufacturing a liquid ejection head. The liquid ejection head includes a recording device substrate configured to eject liquid, an electric wiring member configured to be electrically connected to the recording device substrate at an electric connection portion, and a support member including a concave portion configured to store the recording device substrate and a convex portion protruding from an inner surface of the concave portion toward the recording device substrate. The convex portion includes a first surface and a second surface, the first surface is located at a position higher than a surface of the concave portion on which the recording device substrate is to be placed, and the second surface is located at a position higher than the first surface. The method includes applying an adhesive to the surface of the concave portion on which the recording device substrate is to be placed and to the first surface of the convex portion, pressing the applied adhesive after the recording device substrate is placed on the surface of the concave portion on which the recording device substrate is to be placed, to fill, with the adhesive, a gap between the convex portion and the recording device substrate facing the convex portion from the surface of the concave portion on which the recording device substrate is to be placed to a position higher than the first surface, and sealing the electric connection portion with a sealing material.

According to another aspect of the present disclosure, a liquid ejection head includes a recording device substrate configured to eject liquid, an electric wiring member configured to be electrically connected to the recording device substrate at an electric connection portion, and a support member including a concave portion configured to store the recording device substrate and a convex portion protruding from an inner surface of the concave portion toward the recording device substrate. The convex portion includes a first surface and a second surface, the first surface is located at a position higher than a surface of the concave portion on which the recording device substrate is to be placed, and the second surface is located at a position higher than the first surface. A gap between the convex portion and the recording device substrate facing the convex portion is filled with an adhesive from the surface of the concave portion on which the recording device substrate is to be placed to a position higher than the first surface. The electric connection portion is covered with a sealing material.

Further features and aspects of the present disclosure will become apparent from the following description of example embodiments with reference to the attached drawings.

DESCRIPTION OF THE EMBODIMENTS

Accordingly, the present disclosure is directed to formation of an excellent wall portion that suppresses extension of the sealing material, by the adhesive between the recording device substrate and the convex portion while suppressing protrusion of the adhesive from the ejection port surface as much as possible.

Some example embodiments of the present disclosure are described in detail below.

(Example Liquid Ejection Head)

Figure 1:
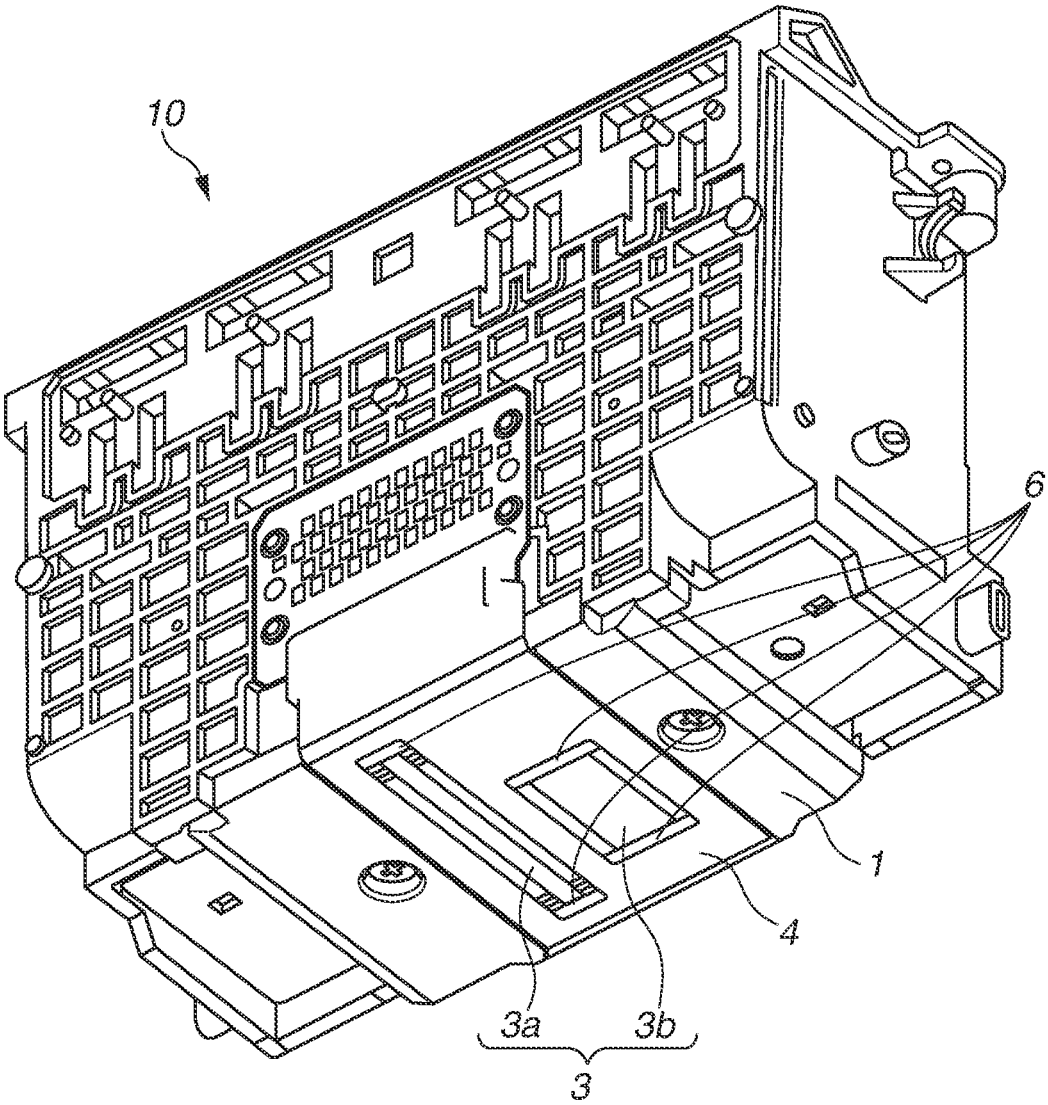
FIG. 1 is a perspective view illustrating an example liquid ejection head according to a first example embodiment.

A liquid ejection head according to a first example embodiment is described with reference to FIG. 1. FIG. 1 is a perspective view illustrating a liquid ejection head 10 according to the present example embodiment. The liquid ejection head 10 mainly includes a recording device substrate 3 that ejects liquid, a support member 1 that supports the recording device substrate 3 a housing to which a liquid tank containing the liquid is attached, and an electric wiring member 4 electrically connected to the recording device substrate 3. The electric wiring member 4 is, for example, a flexible board. In the present example embodiment, a recording device substrate 3*a* is a recording device substrate that ejects black ink, and a recording device substrate 3*b* is a recording device substrate that ejects color ink of three colors other than black. The electric wiring member 4 is to supply power driving a heater inside the recording device substrate 3, to the heater, and is placed on the support member 1 supporting the recording device substrate 3.

The recording device substrate 3 and the electric wiring member 4 are electrically connected to each other, and an electric connection portion thereof is covered with a sealing material 6 so as not to be exposed. The ink is supplied from the liquid tank attached to the housing to the recording device substrates 3*a* and 3*b* through the support member 1. Further, the ink supplied through driving of the heater is ejected from ejection ports 7 (FIG. 3C) of the recording device substrates 3*a* and 3*b*.

(Example Support Member)

Figure 2:
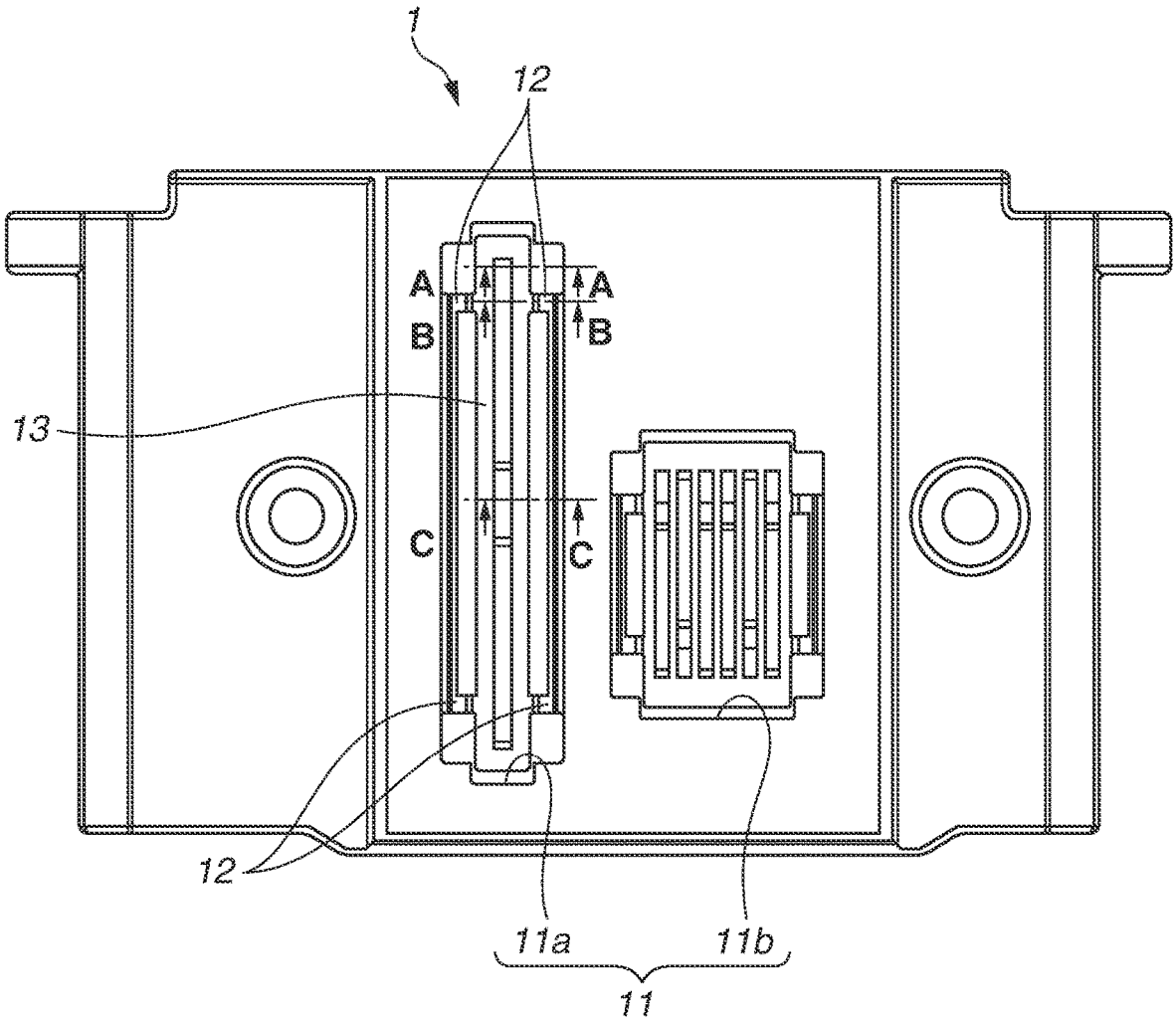
FIG. 2 is a plan view illustrating an example support member.

The support member 1 is described with reference to FIG. 2 and FIGS. 3A to 3C. Although the support member 1 in a region where the recording device substrate 3*a* ejecting the black ink is placed is described below, the support member 1 in a region where the recording device substrate 3*b* for color ink is placed has the similar configuration. FIG. 2 is a plan view illustrating the support member 1. The support member 1 includes concave portions 11*a* and 11*b* that are portions corresponding to the regions where the recording device substrates 3*a* and 3*b* are placed and are recessed from a surrounding surface of the support member 1 on which the electric wiring member 4 is placed. This is to make a height of an inner lead 41 (FIG. 3C) of the electric wiring member 4 and a height of terminals 31 of the recording device substrates 3*a* and 3*b* substantially equal to each other, thereby improving reliability of the electric connection portion therebetween.

Figure 3A:
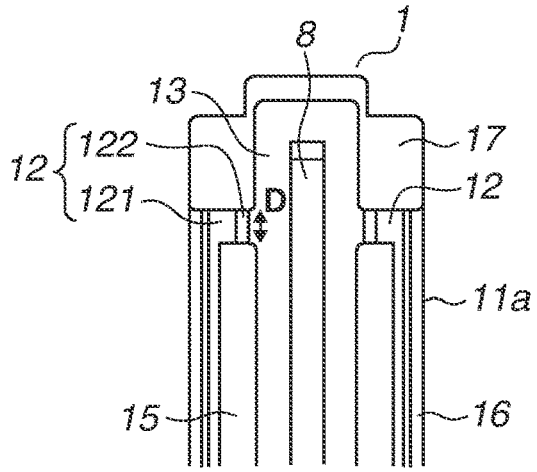
FIGS. 3A to 3C are schematic views illustrating a part of the support member.
Figure 3B:
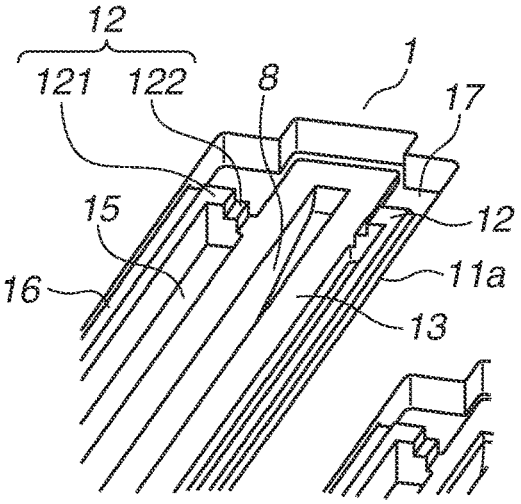
Figure 3C:
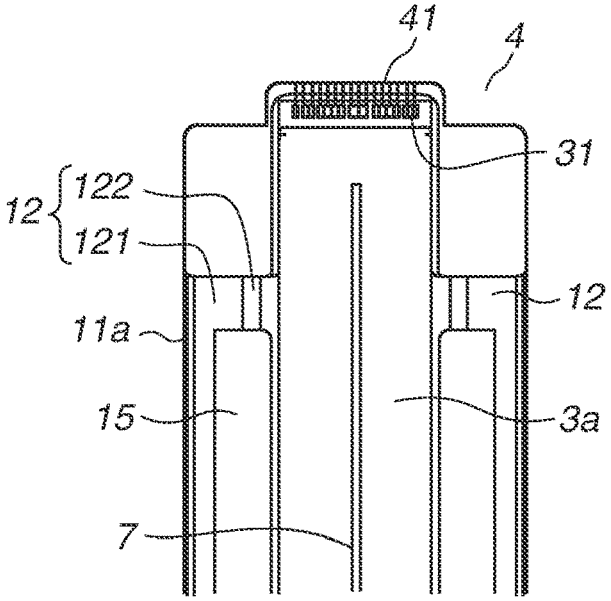
Figure 4A:
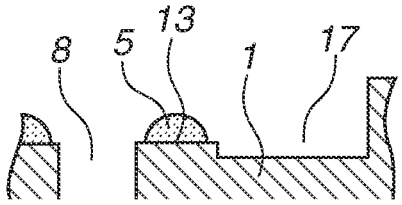
FIGS. 4A to 4D are schematic views illustrating an example step of applying an adhesive to a concave portion.
Figure 4B:
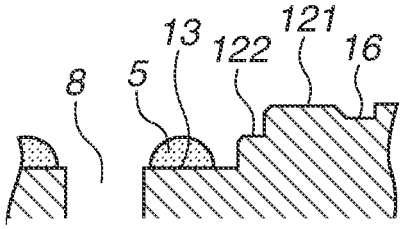
Figure 4C:
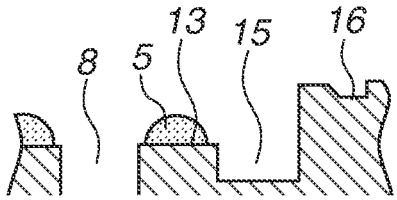
Figure 4D:
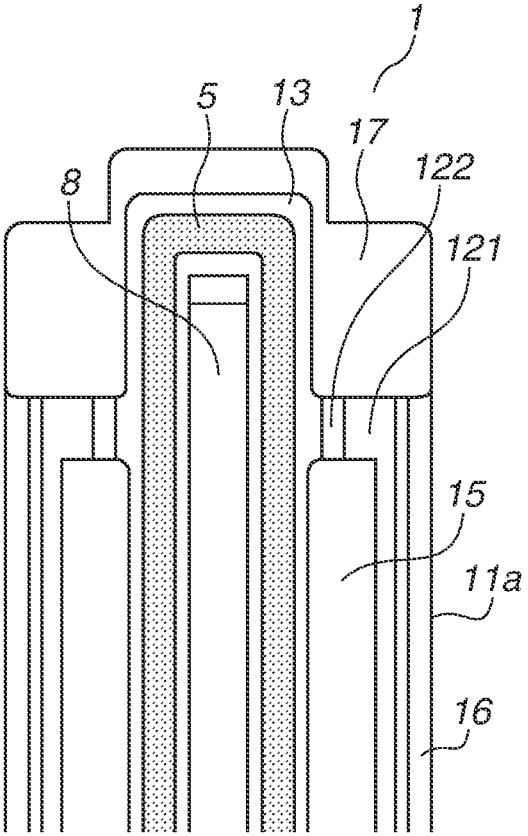
Figure 5A:
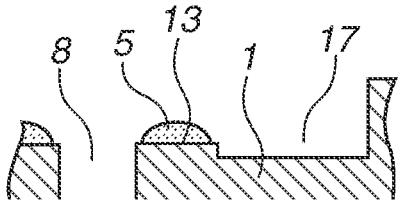
FIGS. 5A to 5D are schematic views illustrating an example step of applying the adhesive to a convex portion.
Figure 5B:
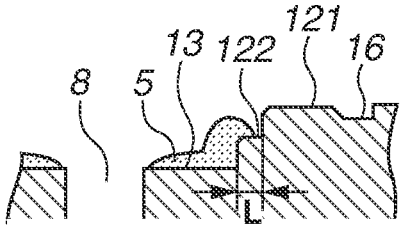
Figure 5C:
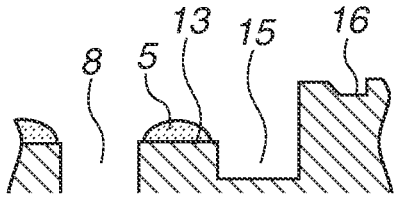
Figure 5D:
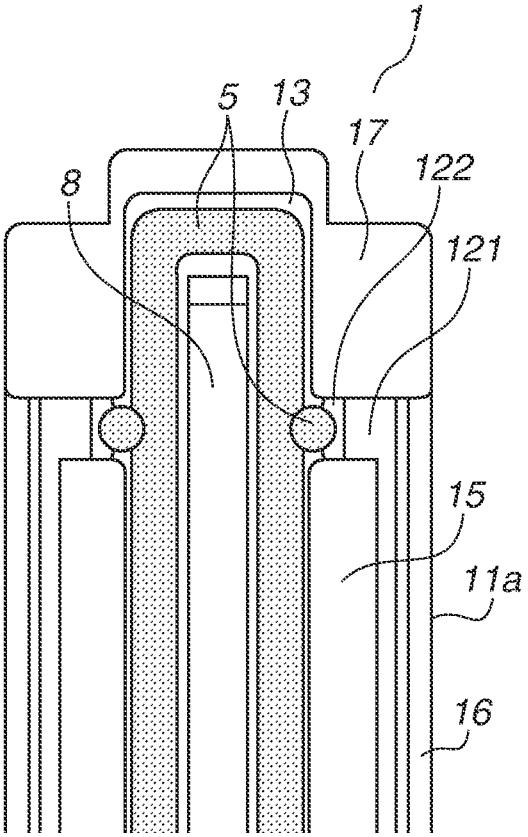
Figure 6A:
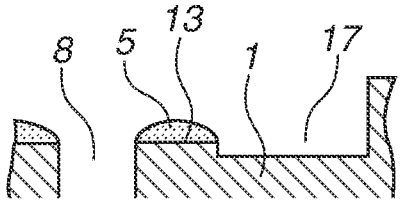
FIGS. 6A to 6D are schematic views illustrating a state where the adhesive is diffused.
Figure 6B:
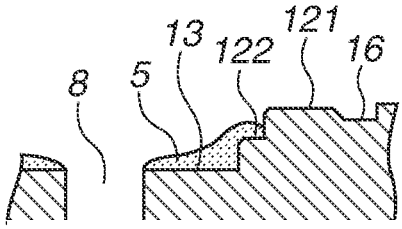
Figure 6C:
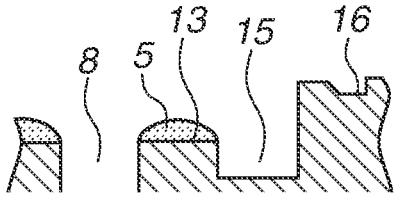
Figure 6D:
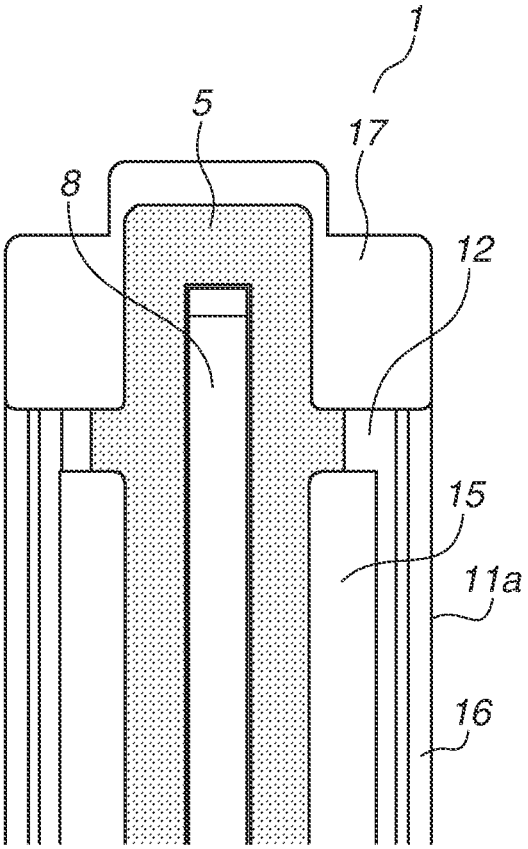

FIG. 3A is a plan view illustrating a part of the support member 1 illustrated in FIG. 2 in an enlarged manner. FIG. 3B is a perspective view illustrating the support member 1 illustrated in FIG. 3A. FIG. 3C is a plan view illustrating a state where the recording device substrate 3*a* is placed on the support member 1 and the terminal 31 of the placed recording device substrate 3*a* and the inner lead 41 of the electric wiring member 4 are electrically connected to each other. In FIG. 3C, the plurality of ejection ports 7 is illustrated in a simplified manner As illustrated in FIGS. 3A and 3B, an adhesive applied surface 13 to which an adhesive 5 (FIGS. 4A to 4D) is to be applied is provided at a center of a bottom surface of the concave portion 11*a* in which the recording device substrate 3*a* is to be stored. The adhesive 5 is used to bond the recording device substrate 3*a* and the support member 1. Further, a liquid supply port 8 to supply the liquid to the ejection ports 7 is provided in the support member 1.

A convex portion 12 protruding inward is provided on an inner surface of the concave portion 11*a*. Although detail is described below, the convex portion 12 is used to form a wall portion 51 (FIGS. 7B and 7D) by the adhesive 5 in a gap 9 (FIG. 7B) between the convex portion 12 and the recording device substrate 3*a*. Further, the convex portion 12 includes a first surface 122 that is located at a position higher than the adhesive applied surface 13, and a second surface 121 that is located at a position higher than the first surface 122. In the present example embodiment, the convex portion 12 has a step shape. In the example embodiment, a direction from the adhesive applied surface 13 toward an ejection port surface 19 (FIGS. 7A to 7D) along a gravity direction is a direction from a lower side toward a higher side. The second surface 121 is a surface at a root of the convex portion 12, and a height of the second surface 121 is substantially equal to a height of the surface of the support member 1 where the electric wiring member 4 is placed. On the other hand, the first surface 122 is a surface located at a front end of the convex portion 12, and a height of the first surface 122 from the adhesive applied surface 13 is equal to about a half of a thickness of the recording device substrate 3*a*. To reduce force applied to the recording device substrate 3 due to contraction of the sealing material 6, the convex portion 12 is preferably located at a position as close as possible to the electric connection portion of the electric wiring member 4 and the recording device substrate 3*a*.

In the present example embodiment, the convex portion 12 is provided only at a position facing a long-side portion (side portion not provided with terminal 31) of the recording device substrate 3*a*. The convex portion 12 may be provided also at a position facing a short-side portion (side portion provided with terminal 31) of the recording device substrate 3*a*.

(Example Method of Manufacturing Liquid Ejection Head)

Next, a method of manufacturing the liquid ejection head according to the example embodiment is described with reference to FIG. 4A to FIG. 15. More specifically, steps from a step of bonding the recording device substrate 3*a* for black ink to the support member 1 to a step of sealing the electric connection portion of the recording device substrate 3*a* and the electric wiring member 4 are described. In a liquid ejection head manufacturing process, steps other than the steps from the bonding step to the sealing step are similar to steps in a normal manufacturing process. Therefore, description of the steps is omitted. Further, the bonding step and the sealing step of the recording device substrate 3*b* for color ink are similar to the steps of the recording device substrate 3*a* for black ink. Therefore, description of the steps is omitted.

(Example Case of Adhesive with High Thixotropy)

Figure 9:
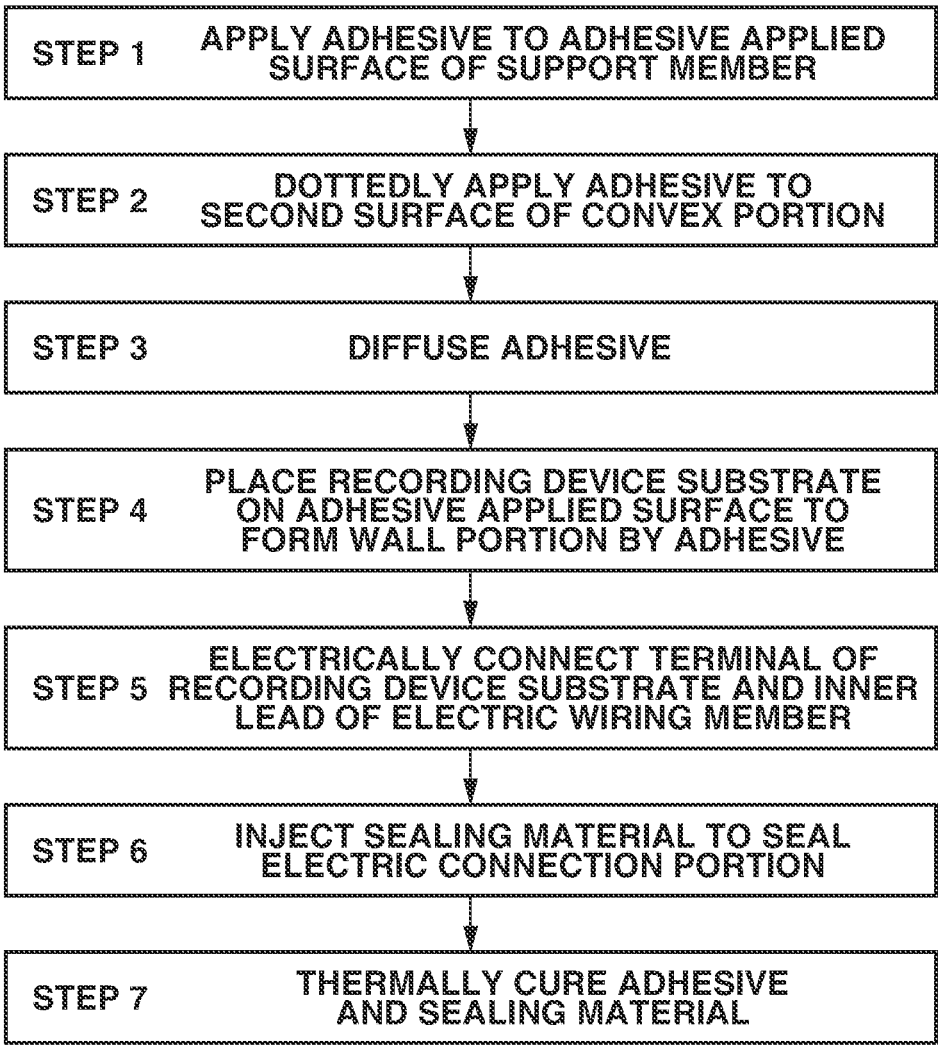
FIG. 9 is a flowchart illustrating an example manufacturing process.
Figure 10A:
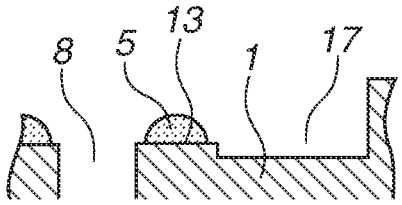
FIGS. 10A to 10D are schematic views illustrating an example step of applying the adhesive to the concave portion.
Figure 10B:
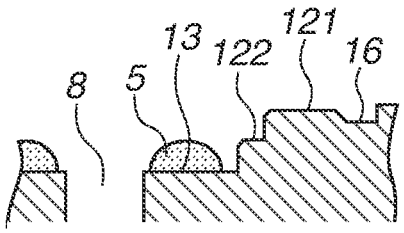
Figure 10C:
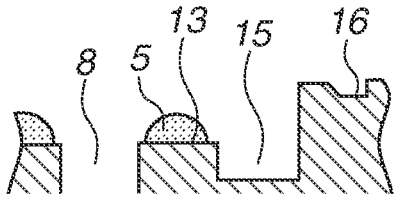
Figure 10D:
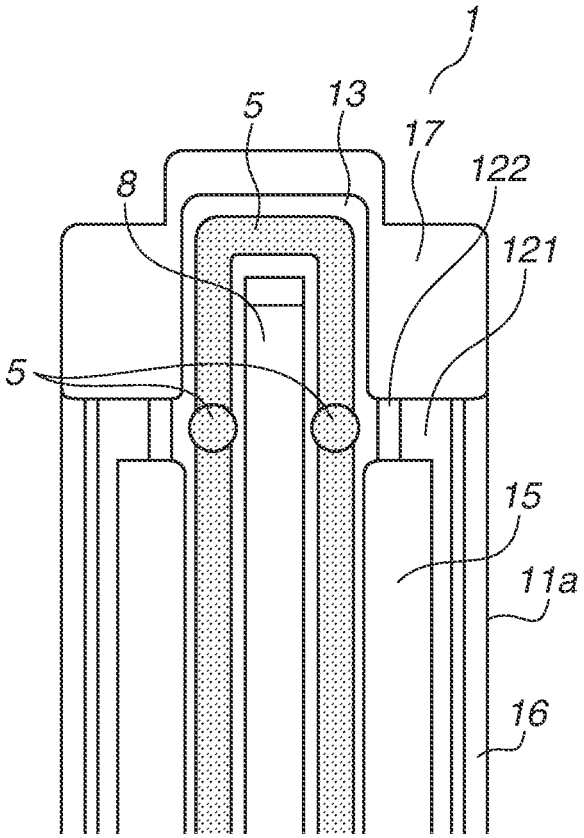
Figure 11A:
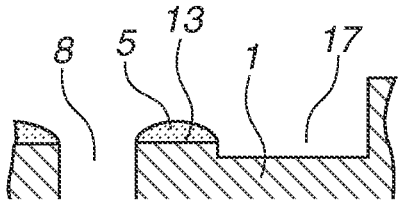
FIGS. 11A to 11D are schematic views illustrating a state where the adhesive is diffused.
Figure 11B:
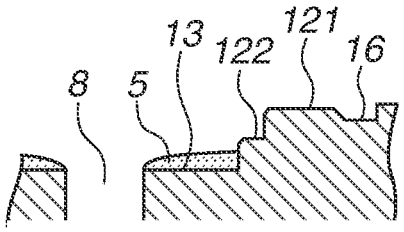
Figure 11C:
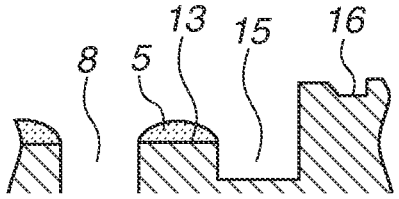
Figure 11D:
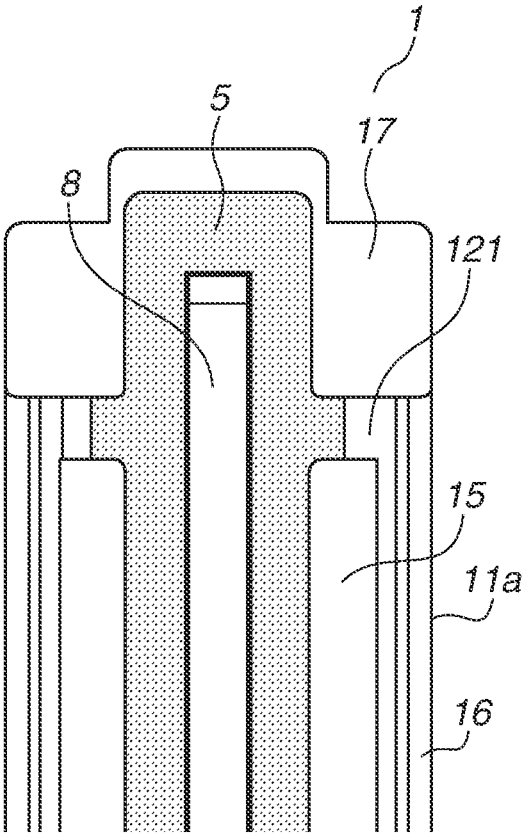
Figure 12A:
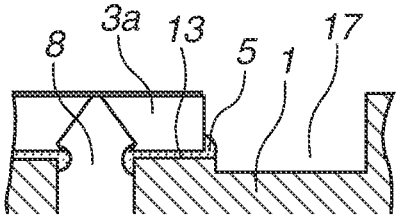
FIGS. 12A to 12D are schematic views illustrating an example step of placing the recording device substrate on the concave portion.
Figure 12B:
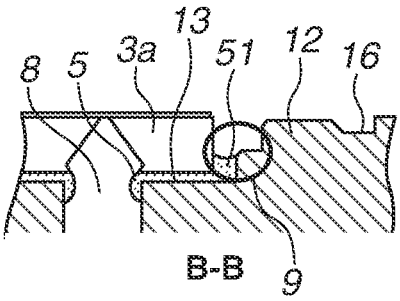
Figure 12C:
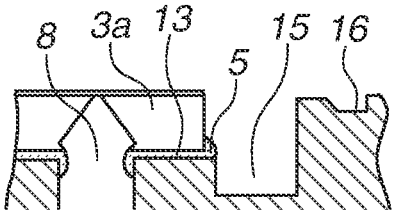
Figure 12D:
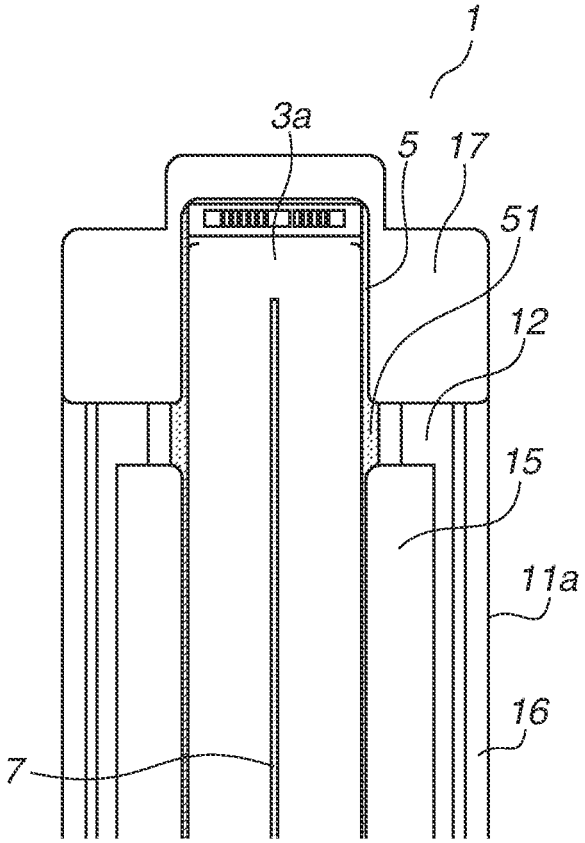
Figure 13A:
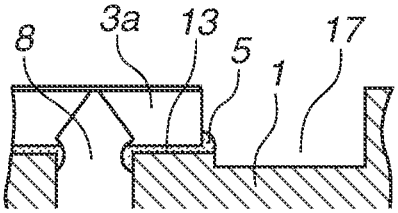
FIGS. 13A to 13D are schematic views illustrating an example step of applying the adhesive to the convex portion.
Figure 13B:
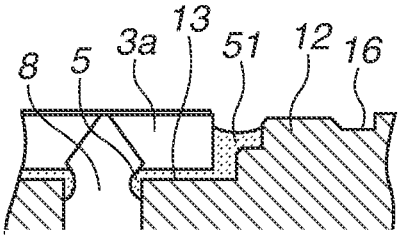
Figure 13C:
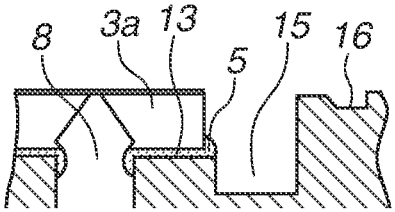
Figure 13D:
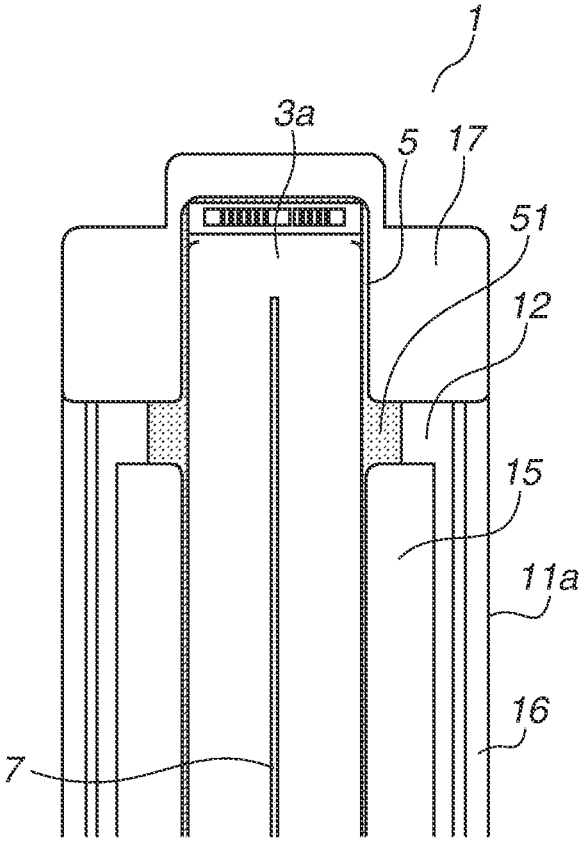
Figure 14A:
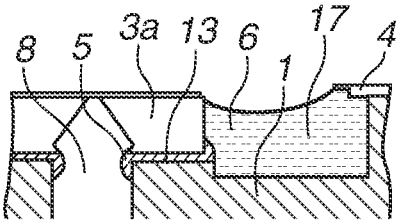
FIGS. 14A to 14D are schematic views illustrating an example step of injecting the sealing material.
Figure 14B:
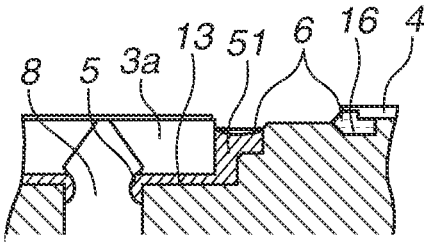
Figure 14C:
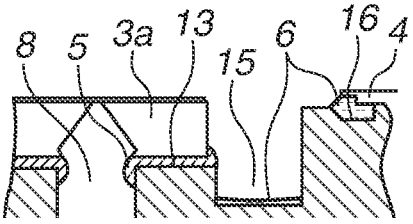
Figure 14D:
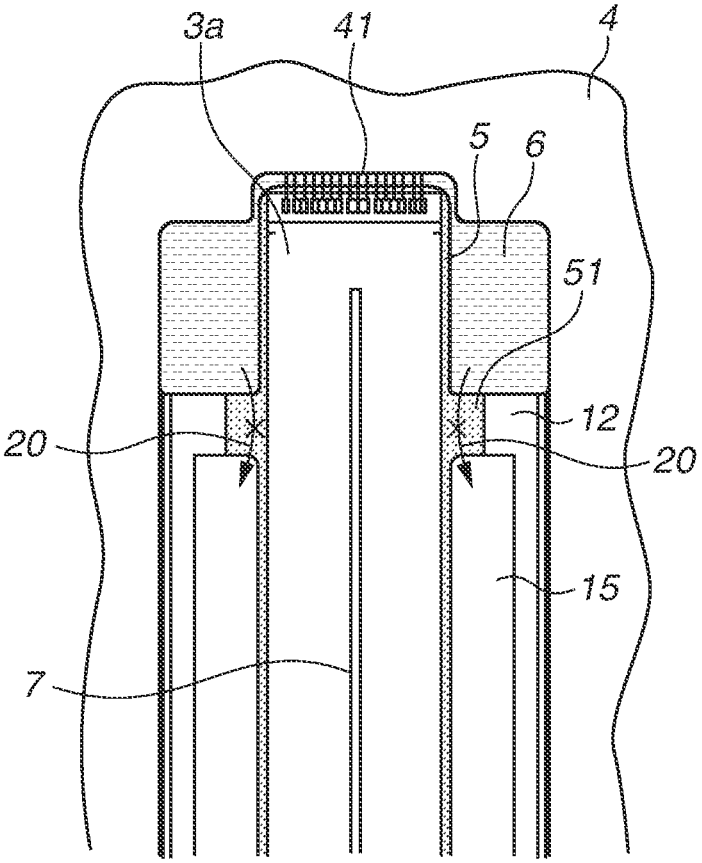

First, the steps from the bonding step to the sealing step in a case where an adhesive with high thixotropy (thixotropy index is 3 or more) is used are described with reference to FIG. 4A to FIG. 9. FIG. 4A, FIG. 5A, FIG. 6A, FIG. 7A, and FIG. 8A are cross-sectional views taken along cut line A-A illustrated in FIG. 2. FIG. 4B, FIG. 5B, FIG. 6B, FIG. 7B, and FIG. 8B are cross-sectional views taken along cut line B-B illustrated in FIG. 2. FIG. 4C, FIG. 5C, FIG. 6C, FIG. 7C, and FIG. 8C are cross-sectional views taken along cut line C-C illustrated in FIG. 2. FIG. 4D, FIG. 5D, FIG. 6D, FIG. 7D, and FIG. 8D are top views of the support member illustrating an applied region of the adhesive 5. FIG. 9 is a flowchart illustrating the manufacturing process illustrated in FIG. 4A to FIG. 8D.

First, as illustrated in FIGS. 4A to 4D, an application step (step S1 in FIG. 9) of applying the adhesive 5 to the adhesive applied surface 13 is performed. At this time, the support member 1 is formed by injection molding using a resin, and 40 mass % of inorganic filler is mixed in the resin (modified polyphenylene ether) in order to improve rigidity and to bring a linear expansion coefficient close to a linear expansion coefficient of the recording device substrate. In the present example embodiment, a thermosetting adhesive is applied to the adhesive applied surface 13 while performing scanning with a needle having an inner diameter of, for example, 0.4 mm. The reason the needle having the inner diameter of 0.4 mm is used is because a wall width between supply ports of the recording device substrate 3*b* ejecting the ink of the plurality of colors is 0.4 mm to 0.5 mm, and a needle inner diameter optimum to bond that part is 0.4 mm.

Next, as illustrated in FIGS. 5A to 5D the adhesive 5 is applied to the first surface 122 of the convex portion 12 by using the above-described needle having the inner diameter (diameter) of 0.4 mm (step S2 in FIG. 9). The inner diameter does not include a thickness of an outer wall of the needle. In the present example embodiment, the adhesive 5 is applied to the first surface 122 without performing scanning with the needle. To form the wall portion 51 (FIGS. 7B and 7D) by the adhesive 5, it is necessary to apply the adhesive 5 so as to pile up the adhesive 5 on the adhesive applied surface 13. Accordingly, the adhesive 5 is applied also to the first surface 122, and a part of the applied adhesive 5 is merged to the adhesive 5 applied to the adhesive applied surface 13 to pile up the adhesive 5 from the adhesive applied surface 13 at least to the height of the first surface 122.

In contrast, although detail is described below, in a case where the convex portion 12 does not include the first surface 122 (FIG. 16D), it is necessary to apply the adhesive to the top surface 121 of the convex portion 12 in order to pile up the adhesive on the adhesive applied surface 13. Therefore, in the present example embodiment, the convex portion 12 is formed to have the step shape and the adhesive 5 is applied to the first surface 122. This makes it possible to pile up the adhesive 5 on the adhesive applied surface 13 while avoiding application of the adhesive 5 to the top surface 121 of the convex portion 12. Note that the adhesive 5 is applied to the first surface 122 without performing scanning with the needle; however, the present example embodiment is not limited thereto, and the adhesive 5 may be applied to the first surface 122 while performing scanning with the needle.

The adhesive 5 is applied to the first surface 122 such that a part of about 0.1 mm corresponding to ¼ of a needle inner diameter d from an end of the needle inner diameter d is overlapped with the first surface 122. A remaining part of the first surface 122 on which the adhesive 5 is not applied, is a part on which the wall portion 51 is to be formed. Accordingly, a length L of the first surface 122 in a direction orthogonal to a direction in which the convex portion 12 protrudes preferably satisfies (¼ of inner diameter d=0.1 mm)+(thickness w of outer wall of needle=0.1 mm)+(gap to prevent outer wall of needle and end of second surface 121 from contacting=0.1 mm to 0.2 mm)=0.3 mm to 0.4 mm.

Further, a width D (FIG. 3A) of the convex portion 12 is preferably about 0.8 mm to 1.2 mm in order not to make molding difficult and in order to reduce the amount of adhesive 5 applied to the first surface 122. Further, in the case where the adhesive 5 is applied to the first surface 122, it is desirable to prevent the adhesive 5 from protruding from the ejection port surface of the recording device substrate 3*a* after the recording device substrate 3*a* described below is placed. Accordingly, the height of the first surface 122 from the adhesive applied surface 13 is preferably lower by 0.3 mm or more than the height of the second surface 121. To pile up the adhesive 5, however, it is necessary for the first surface 122 to have a certain height. Therefore, a difference between the height of the first surface 122 from the adhesive applied surface 13 and the height of the second surface 121 from the adhesive applied surface 13 is preferably lower than or equal to 0.5 mm.

In a case where the first surface has a curved surface shape or an inclined shape as with a second example embodiment, the height of the first surface 122 from the adhesive applied surface 13 indicates an average of heights (at randomly-selected 10 positions) of the first surface 122 from the adhesive applied surface 13.

Thereafter, as illustrated in FIGS. 6A to 6D, the applied adhesive 5 is diffused within the adhesive applied surface 13 with a lapse of time (step S3 in FIG. 9). The adhesive applied surface 13 is located slightly higher than a lateral region 15 (FIGS. 3A to 3C) and a pocket 17 of the support member 1. Therefore, diffusion of the adhesive is stopped at an edge of the adhesive applied surface 13. As a result, the adhesive 5 applied to the adhesive applied surface 13 stays within the adhesive applied surface 13, which makes it possible to minimize the application amount of adhesive 5.

Figure 7A:
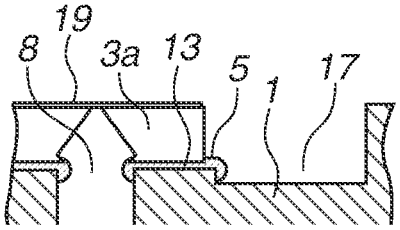
FIGS. 7A to 7D are schematic views illustrating an example step of placing a recording device substrate on the concave portion.
Figure 7B:
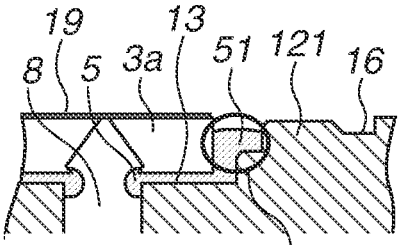
Figure 7C:
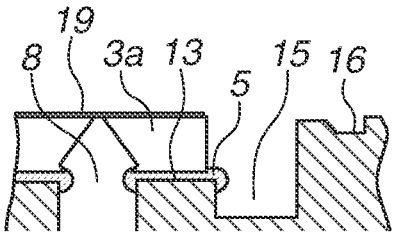
Figure 7D:
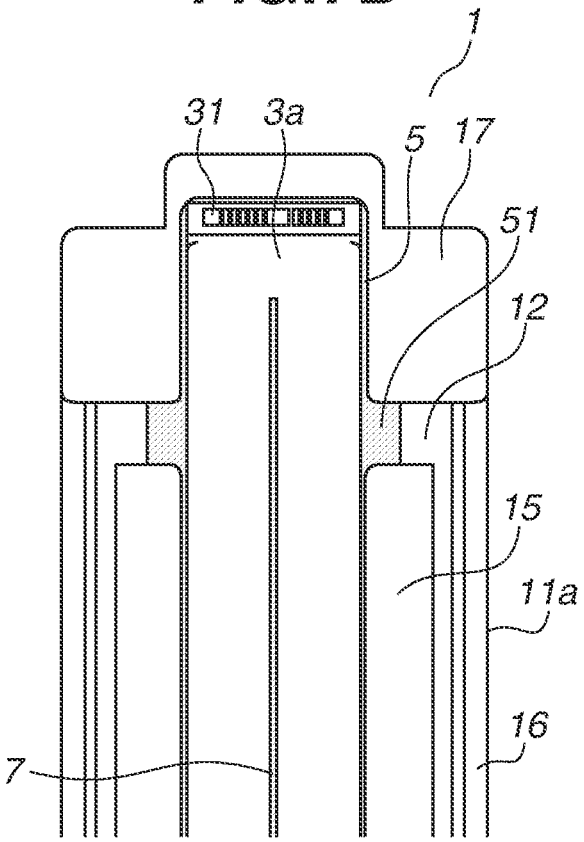
Figure 8A:
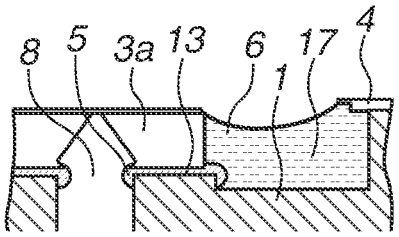
FIGS. 8A to 8D are schematic views illustrating an example step of injecting a sealing material.
Figure 8B:
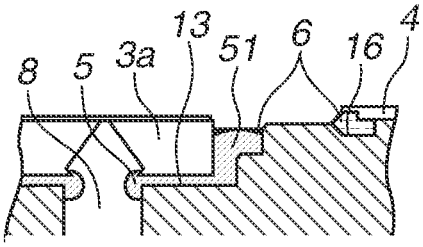
Figure 8C:
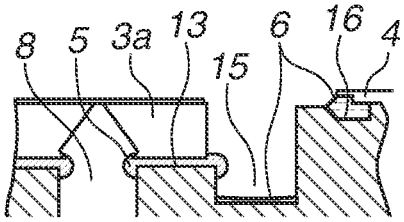
Figure 8D:
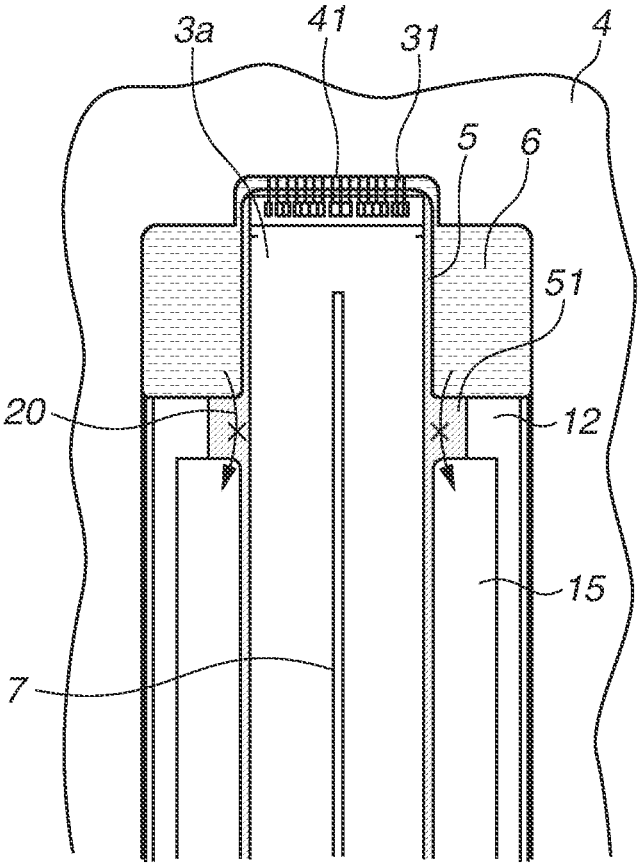

Next, as illustrated in FIGS. 7A to 7D, the recording device substrate 3*a* is placed on the adhesive applied surface 13 (step S4 in FIG. 9). At this time, the adhesive 5 applied to the adhesive applied surface 13 is pressed by the recording device substrate 3*a* and is extruded to outside (liquid supply port 8 side and opposite side thereof) from the adhesive applied surface 13 (pressing step). In FIG. 7B, as a result of extrusion of the adhesive 5, the gap 9 between the recording device substrate 3*a* and the convex portion 12 of the support member 1 is filled with the extruded adhesive 5 and the adhesive 5 applied to the first surface 122 of the convex portion 12, and the wall portion 51 by the adhesive 5 is formed. At this time, the height of the wall portion 51 from the adhesive applied surface 13 is higher than at least the height of the first surface 122. To prevent the sealing material 6 described below (FIGS. 8A to 8D) from flowing into a side-surface region of the recording device substrate 3*a*, the gap 9 from the first surface 122 up to a position of ¾ or more of a distance between the first surface 122 and the second surface 121 is preferably filled with the adhesive 5.

Next, an electric connection step of connecting the electric wiring member 4 to the support member 1, and electrically connecting the terminal 31 (FIG. 3C) of the recording device substrate 3*a* and the inner lead 41 (FIG. 3C) of the electric wiring member 4 is performed (step S5 in FIG. 9). Subsequently, as illustrated in FIGS. 8A to 8D, to protect the electric connection portion of the terminal 31 and the inner lead 41, and the inner lead 41 from the liquid such as the ink and external force, the sealing material 6 is injected into a portion around the electric connection portion (step S6 in FIG. 9). The sealing material 6 commonly has low viscosity. Therefore, the injected sealing material 6 flows not only to the portion around the electric connection portion but also to, for example, the side-surface region 15 of the recording device substrate 3*a*. In the present example embodiment, however, since the wall portion 51 by the adhesive 5 is provided between the pocket 17 and the side-surface region 15 as described above, flowing of the sealing material 6 to the side-surface region 15 is prevented by the wall portion 51. In other words, it is possible to prevent the sealing material 6 from coming into contact with a wide range of the side surface of the recording device substrate 3*a*. Further, to protect the electric wiring member 4, the sealing material 6 is flowed into a groove 16.

Finally, the support member 1 is left in a high-temperature environment for a prescribed time to thermally cure the adhesive 5 and the sealing material 6. This stabilizes bonding of the recording device substrate 3*a* and the support member 1 (step S7 in FIG. 9).

Although detail is described below, in the case where the adhesive with high thixotropy is used, the adhesive 5 may be applied to the first surface 122 after the recording device substrate 3*a* is placed on the concave portion 11*a* as with a case where an adhesive with low thixotropy is used. This makes it possible to form the excellent wall portion 51. However, when the adhesive 5 is applied to the first surface 122 after the recording device substrate 3*a* is placed, the adhesive 5 may be adhered to the ejection port surface. Therefore, the adhesive 5 is more preferably applied to the first surface 122 before the recording device substrate 3*a* is placed as described above. Further, when the adhesive 5 is applied to the first surface 122 after the recording device substrate 3*a* is placed, a gap may occur between the adhesive 5 applied before the recording device substrate 3*a* is placed and the adhesive 5 applied after the recording device substrate 3*a* is placed. Therefore, the adhesive 5 is preferably applied to the first surface 122 before the recording device substrate 3*a* is placed.

(Example Case of Adhesive with Low Thixotropy)

Figure 15:
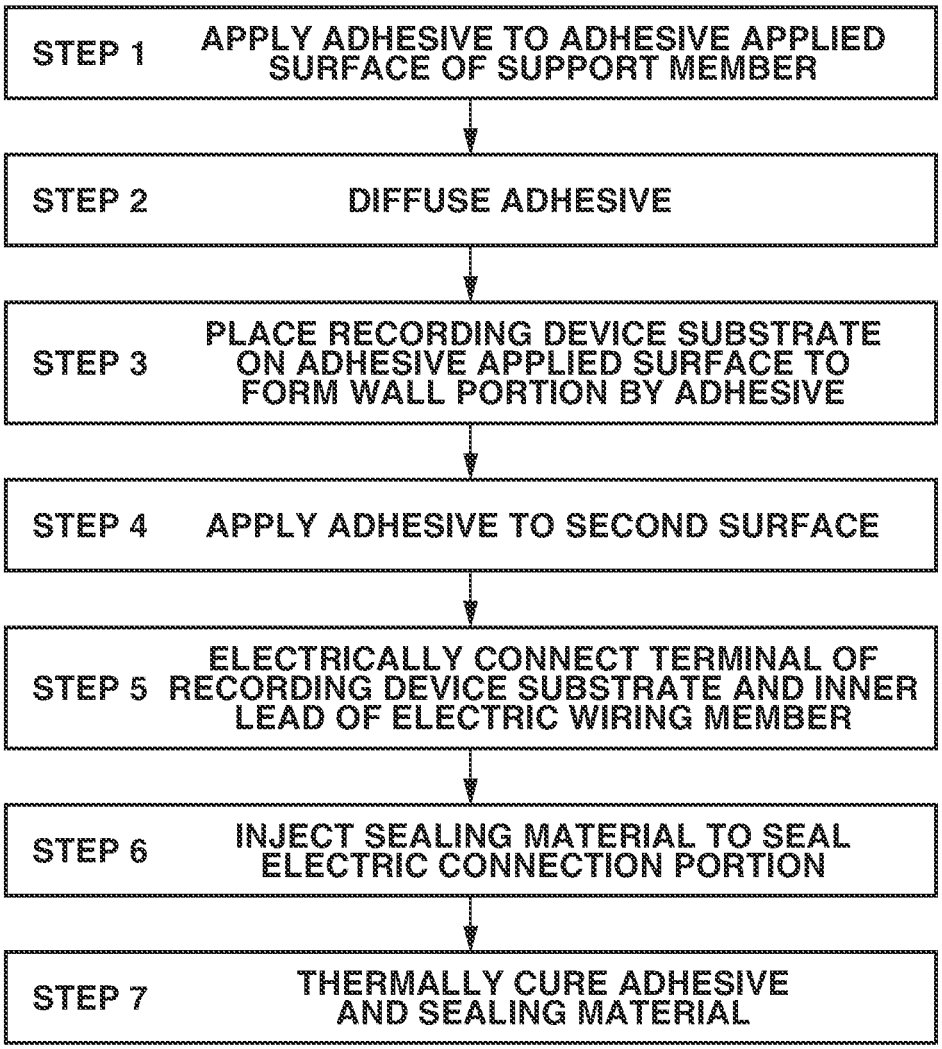
FIG. 15 is a flowchart illustrating an example manufacturing process.

Next, the steps from the bonding step to the sealing step in a case where an adhesive with low thixotropy (thixotropy index is 1 or less) is used is described with reference to FIG. 10A to FIG. 14D. FIG. 10A, FIG. 11A, FIG. 12A, FIG. 13A and FIG. 14A are cross-sectional views taken along cut line A-A illustrated in FIG. 2. FIG. 10B, FIG. 11B, FIG. 12B, FIG. 13B, and FIG. 14B are cross-sectional views taken along cut line B-B illustrated in FIG. 2. FIG. 10C, FIG. 11C, FIG. 12C, FIG. 13C and FIG. 14C are cross-sectional views taken along cut line C-C illustrated in FIG. 2. FIG. 10D, FIG. 11D FIG. 12D, FIG. 13D, and FIG. 14D are top views of the support member illustrating an applied region of the adhesive 5. FIG. 15 is a flowchart illustrating the manufacturing process illustrated in FIG. 10A to FIG. 14D. Detailed description of steps similar to the above-described steps in the manufacturing process in the case where the adhesive with high thixotropy is used is omitted.

First, as illustrated in FIGS. 10A to 10D, the adhesive 5 is applied to the adhesive applied surface 13 by the needle (step S1 in FIG. 15). At this time, to secure a certain height of the wall portion 51 (FIGS. 12B and 12D) in a step illustrated in FIGS. 12A to 12D, the needle is stopped for a prescribed time at a portion of the adhesive applied surface 13 facing the convex portion 12, to increase the application amount of adhesive 5 at that portion. Thereafter, as illustrated in FIGS. 11A to 11D, the applied adhesive 5 is diffused within the adhesive applied surface 13 with a lapse of time (step S2 in FIG. 15). The stop time of the needle may not be provided depending on the necessary height of the wall portion 51. Further, in the present example embodiment, the adhesive 5 is applied only to the adhesive applied surface 13; however, the adhesive 5 may be applied to the first surface 122 of the convex portion 12. In the case of the adhesive 5 with low thixotropy, the adhesive on the first surface 122 immediately falls onto the adhesive applied surface 13. Therefore, the adhesive 5 is less piled up than the case of the adhesive 5 with high thixotropy described above.

Next, as illustrated in FIGS. 12A to 12D the recording device substrate 3*a* is placed on the adhesive applied surface 13 (step S3 in FIG. 15). At this time, the adhesive 5 applied to the adhesive applied surface 13 is pressed by the recording device substrate 3*a* and is extruded to outside (liquid supply port 8 side and opposite side thereof) from the adhesive applied surface 13. Out of the extruded adhesive 5, the adhesive 5 extruded to the vicinity of the convex portion 12 rises in the gap 9 between the convex portion 12 and the recording device substrate 3*a* by capillary force acting on the gap 9. The adhesive 5 rising by the capillary force acting on the gap 9 rises only up to the height of the first surface 122 of the convex portion 12 in most cases. This is because the capillary force is reduced when the width of the gap 9 is widened at the first surface 122.

After the recording device substrate 3*a* is placed, as illustrated in FIGS. 13A to 13D, the adhesive 5 is additionally applied to the first surface 122 of the convex portion 12 to fill the gap 9 with the adhesive 5, thereby forming the wall portion 51 (step S4 in FIG. 15). As a result, the wall portion 51 can be formed by the adhesive 5 rising by the capillary force and the adhesive 5 additionally applied to the first surface 122. This makes it possible to stably form the wall portion 51 having the sufficient height without applying the adhesive 5 to the top surface 121 of the convex portion 12.

Next, as illustrated in FIGS. 14A to 14D, the inner lead 41 and the terminal 31 of the recording device substrate 3*a* are electrically connected, and the sealing material 6 is injected from the pocket 17 of the support member 1 to first seal the lower side of the inner lead 41 with the sealing material 6. At this time, the flow of the sealing material 6 is regulated by the provided wall portion 51, and the sealing material 6 does not flow over the wall portion 51 as illustrated by an arrow 20. As a result, the contact region of the sealing material 6 and the recording device substrate 3*a* is limited only to the region on the pocket 17 side of the wall portion 51. This makes it possible to prevent deformation of the recording device substrate 3*a* even if the sealing material 6 is expanded or contracted by heat or the like.

Finally, to protect the electric connection portion of the inner lead 41 and the terminal 31 from the liquid such as the ink and external force, a second sealing material (not illustrated) is applied to the inner lead 41 to seal the electric connection portion. In other words, in the present example embodiment, the sealing step is divided into a step of filling the lower space of the inner lead 41 with the sealing material and a step of covering the upper part of the electric connection portion with the sealing material. In the example embodiment, however, these steps may be simultaneously performed.

Also in the case where the adhesive with low thixotropy is used, the adhesive 5 may be applied to the first surface 122 before the recording device substrate 3*a* is placed, as with the case where the adhesive with high thixotropy is used. It is, however, difficult for the adhesive with low thixotropy to form the excellent wall portion only by application of the adhesive 5 to the first surface 122 before placement, because the adhesive with low thixotropy flows and easily falls from the first surface 122 onto the adhesive applied surface 13. Therefore, even in the case where the adhesive 5 is applied to the first surface 122 before the recording device substrate 3*a* is placed, the adhesive 5 is preferably applied to the first surface 122 again after the recording device substrate 3*a* is placed.

In the present example embodiment, the case where the adhesive 5 does not protrude from the ejection port surface 19 has been described above; however, the present example embodiment is not limited thereto. In other words, the adhesive 5 may protrude from the ejection port surface 19 at a degree not influencing recording quality. As compared with the case where the convex portion 12 does not include the first surface 122, providing the first surface 122 lower in height than the second surface 121 and applying the adhesive 5 to the first surface 122 to form the wall portion 51 make it possible to reduce the protruding amount of the adhesive 5 from the ejection port surface 19.

Figure 18A:
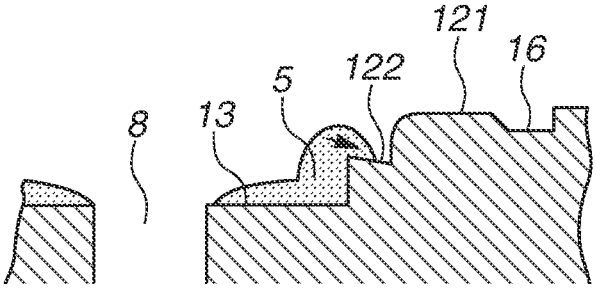
FIGS. 18A to 18C are schematic views illustrating a support member according to a second example embodiment.
Figure 18B:
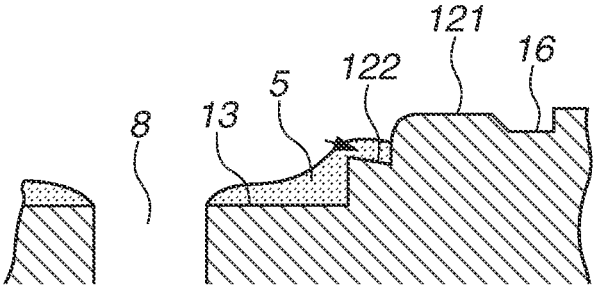
Figure 18C:
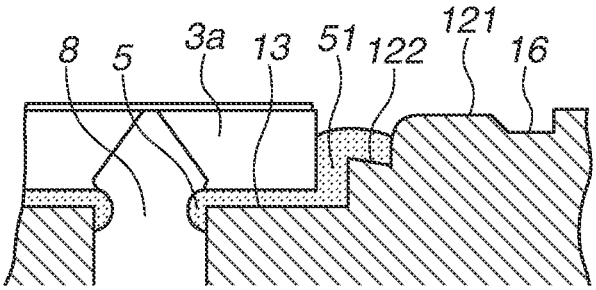

A second example embodiment is described with reference to FIGS. 18A to 18C. FIGS. 18A to 18C are schematic views illustrating a support member according to the second example embodiment, and are cross-sectional views taken along cut line B-B illustrated in FIG. 2. FIG. 18A is a diagram when the adhesive 5 is applied to the adhesive applied surface 13. FIG. 18B is a diagram when the applied adhesive 5 is diffused. FIG. 18C is a diagram when the recording device substrate 3*a* is placed on the adhesive applied surface 13.

The first surface 122 of the convex portion 12 may have an inclined shape in which a height is gradually reduced toward the root of the convex portion 12. This makes it possible to prevent the adhesive 5 applied to the first surface 122 from falling onto the adhesive applied surface 13. Accordingly, the recording device substrate 3*a* can be placed on the adhesive applied surface 13 in a state where more adhesive 5 is present on the first surface 122. In other words, inclination of the first surface 122 allows for more stable formation of the wall portion 51.

(Modification Example)

Figure 19A:
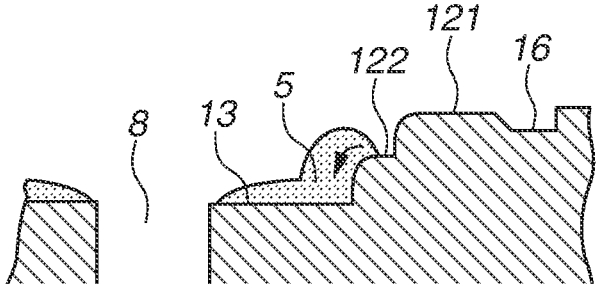
FIGS. 19A to 19C are schematic views illustrating a support member used for description of a modification of the second example embodiment.
Figure 19B:
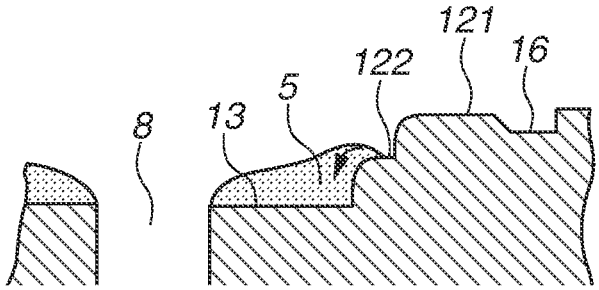
Figure 19C:
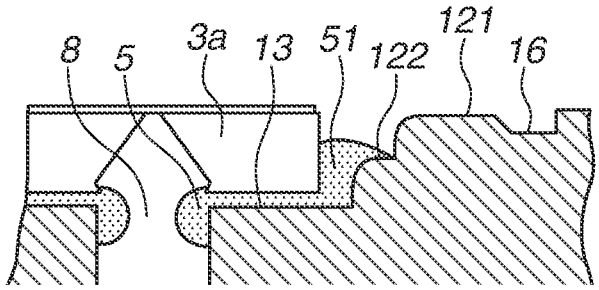

In consideration of moldability of the support member 1, a front end part of the convex portion 12 on the recording device substrate side may be formed in an R-shape or may be chamfered. In this case, the R-shape is preferably formed with less than R0.1, or the chamfering is preferably performed with less than C0.1. This is because, in a case where the R-shape or C-chamfered amount at the end part of the first surface 122 of the convex portion 12 is large, the adhesive 5 applied to the first surface 122 may fall onto the adhesive applied surface 13 with a lapse of time after application. In this case, the height of the wall portion 51 cannot be sufficiently secured, and the amount of adhesive 5 forced out to the liquid supply port 8 is increased (FIGS. 19A to 19C).

(Comparative Example)

Figure 16A:
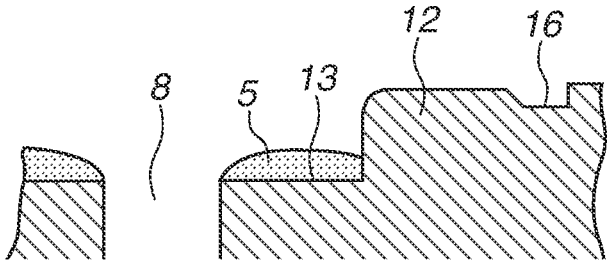
FIGS. 16A to 16C are schematic views illustrating a comparative example.
Figure 16B:
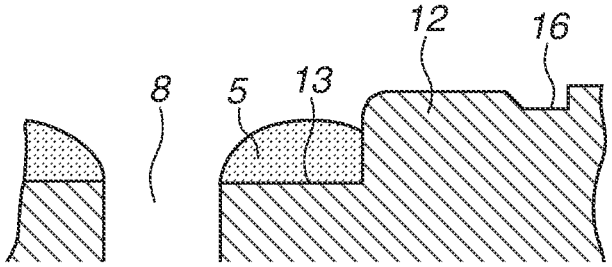
Figure 16C:
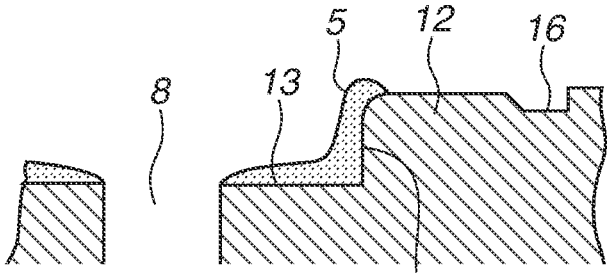
Figure 17A:
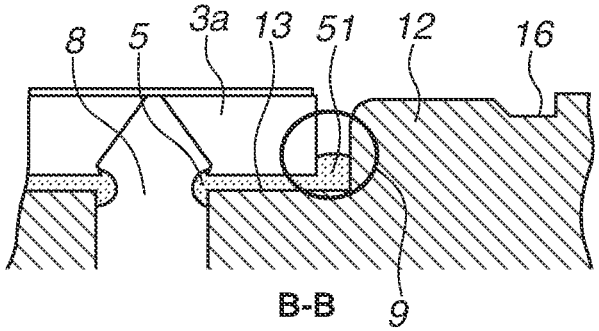
FIGS. 17A to 17C are schematic views illustrating the comparative example.
Figure 17B:
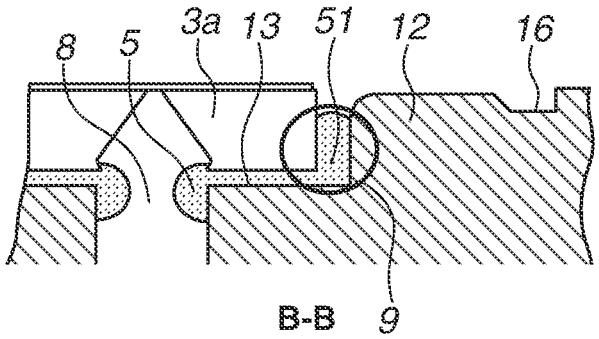
Figure 17C:
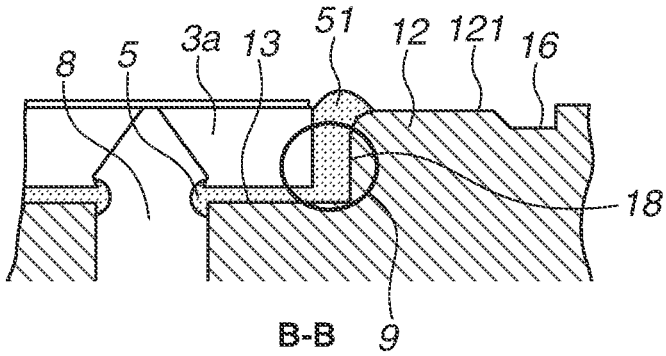

A comparative example according to the example embodiments is described with reference to FIGS. 16A to 16C and FIGS. 17A to 17C. As the comparative example, the support member in which the convex portion 12 does not have the step shape discussed in Japanese Patent Application Laid-Open No. 2012-143896 is described. Further, a case where the adhesive 5 is applied to the adhesive applied surface 13 and is then pressed by the recording device substrate 3 is considered. FIGS. 16A to 16C and FIGS. 17A to 17C are cross-sectional views taken along cut line B-B illustrated in FIG. 2. FIGS. 16A to 16C are diagrams illustrating a state before the recording device substrate 3 is placed on the support member, and FIGS. 17A to 17C are diagrams illustrating a state after the adhesive 5 is pressed by the recording device substrate 3.

FIG. 16A and FIG. 17A illustrate a case where the adhesive 5 with high thixotropy (thixotropy index 3) is used. After the adhesive 5 is applied to the adhesive applied surface 13, the adhesive 5 is diffused to a peripheral edge part of the adhesive applied surface 13 over time (see FIG. 16A). Thereafter, when the adhesive 5 is pressed by the recording device substrate 3, the adhesive 5 extruded by the recording device substrate 3 tries to fill the gap 9 between the convex portion 12 and the side surface of the recording device substrate 3 facing the convex portion 12. However, the rising effect of the adhesive 5 by the capillary force is not high because of high thixotropy, and the adhesive 5 highly possibly stops movement without sufficiently filling the gap 9 (FIG. 17A). Accordingly, in the case where the adhesive with high thixotropy is used, unless the convex portion is formed in the step shape and the adhesive is applied to the step (first surface), it is difficult to form the wall portion having the sufficient height by the adhesive in the first place. Accordingly, the sealing material 6 applied in a subsequent step is highly possibly diffused to the lateral region 15 through the upper part of the adhesive 5.

Next, FIG. 16B and FIG. 17B illustrate a case where the adhesive 5 with high thixotropy as with the adhesive 5 in FIG. 16A is used and the application amount of adhesive 5 is increased as compared with the application amount in FIG. 16A. After the large amount of adhesive 5 is applied to the adhesive applied surface 13 to fill the gap 9 between the convex portion 12 and the side surface of the recording device substrate 3 facing the convex portion 12, the adhesive 5 is diffused to the peripheral edge part of the adhesive applied surface 13 over time (FIG. 16B). Thereafter, when the adhesive 5 is pressed by the recording device substrate 3, the adhesive 5 extruded by the recording device substrate 3 fills the gap 9. However, since the large amount of adhesive 5 is applied to fill the gap 9, it is not certain whether the adhesive 5 stops flowing at the position of the top surface of the convex portion when the adhesive 5 is pressed by the recording device substrate 3. In other words, flowing of the adhesive 5 may continue thereafter, and in this case, the adhesive 5 may protrude from the ejection port surface. Moreover, the amount of adhesive 5 extruded to the liquid supply port 8 may be increased to block a part of the liquid supply port 8, which may influence supply of the liquid to the ejection ports (FIG. 17B). Accordingly, formation of the wall portion 51 in the case where the convex portion does not have the step shape is not preferable because the adhesive 5 may protrude from the ejection port surface and the adhesive 5 may block a part of the liquid supply port 8.

Next, FIG. 16C and FIG. 17C illustrate a case where the wall portion 51 having the sufficient height is formed without large protrusion of the adhesive 5 to the liquid supply port 8 even while the adhesive 5 with high thixotropy is similarly used. The amount of adhesive 5 applied to the adhesive applied surface 13 is reduced as compared with the amount of adhesive 5 in FIG. 16B, which reduces the amount of adhesive 5 extruded to the liquid supply port 8 when the adhesive 5 is pressed by the recording device substrate 3. At this time, to form the wall portion 51 having the sufficient height while the amount of adhesive 5 applied to the adhesive applied surface 13 is reduced, it is necessary to previously pile up the adhesive 5. Since the adhesive 5 gradually drips with a lapse of time, it is necessary to apply the adhesive 5 to a flat surface that serves as a support to prevent the adhesive 5 from dripping in order to maintain the shape of the pilled-up adhesive 5 at a certain degree. Therefore, as illustrated in FIG. 16C, it is necessary to apply the adhesive 5 so as to reach the top surface 121 of the convex portion 12. Thereafter, when the recording device substrate 3 is placed on the support member, the wall portion 51 protrudes from the ejection port surface 19 of the recording device substrate 3 as illustrated in FIG. 17C. As a result, the distance between the ejection port surface 19 and the recording medium is increased, which may influence the recording quality.

As described above, it is difficult to form the excellent wall portion 51 in the case where the adhesive 5 has high thixotropy. Therefore, the configuration and the manufacturing method according to the example embodiments are particularly effective to the case where the adhesive with high thixotropy is used.

According to the example embodiments of the present disclosure, the wall portion that sufficiently prevents extension of the sealing material can be formed by the adhesive between the recording device substrate and the convex portion while suppressing protrusion of the adhesive from the ejection port surface as much as possible.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-068043, filed Mar. 29, 2019, which is hereby incorporated by reference herein in its entirety.

What is claimed is:

1. A method of manufacturing a liquid ejection head, the liquid ejection head including a recording device substrate configured to eject liquid, an electric wiring member configured to be electrically connected to the recording device substrate at an electric connection portion, and a support member including a concave portion configured to store the recording device substrate and a convex portion protruding from an inner surface of the concave portion toward the recording device substrate, the convex portion including a first surface and a second surface that are surfaces along a surface of the concave portion on which the recording device substrate is to be placed, the first surface being located at a position higher than the surface on which the recording device substrate is to be placed and lower than a top surface of the recording device substrate, and the second surface being located at a position higher than the first surface, the method comprising:

applying an adhesive to the surface of the concave portion on which the recording device substrate is to be placed and to the first surface of the convex portion;

pressing the applied adhesive after the recording device substrate is placed on the surface of the concave portion on which the recording device substrate is to be placed, to fill, with the adhesive, a gap between the convex portion and the recording device substrate facing the convex portion from the surface of the concave portion on which the recording device substrate is to be placed to a position higher than the first surface; and sealing the electric connection portion with a sealing material.

2. The method of manufacturing the liquid ejection head according to claim 1, wherein in the pressing, the gap is filled with the adhesive from the first surface up to a position of ¾ or more of a distance between the first surface and the second surface.

3. The method of manufacturing the liquid ejection head according to claim 1, wherein the applied adhesive has a thixotropy index of 3 or more.

4. The method of manufacturing the liquid ejection head according to claim 1, wherein the adhesive is provided at a position lower than a surface provided with an ejection port of the recording device substrate.

5. The method of manufacturing the liquid ejection head according to claim 1, wherein the adhesive is applied using a needle, and a following expression is satisfied:

$$d/4+w+0.1\ \text{mm} \leq L \leq d/4+w+0.2\ \text{mm},$$

where L is a width of the convex portion of the first surface in a direction orthogonal to a protruding direction, d is an inner diameter of the needle, and w is a thickness of an outer wall of the needle.

6. The method of manufacturing the liquid ejection head according to claim 1, wherein the electric wiring member is a flexible board, and wherein the electric connection portion connects an inner lead of the electric wiring member and a terminal of the recording device substrate.

7. The method of manufacturing the liquid ejection head according to claim 1, wherein a height of the first surface from the surface of the concave portion on which the recording device substrate is to be placed, is lower by 0.3 mm or more than a height of the second surface from the surface on which the recording device substrate is to be placed.

8. The method of manufacturing the liquid ejection head according to claim 1, wherein a difference between a height of the first surface from the surface of the concave portion on which the recording device substrate is to be placed and a height of the second surface from the surface on which the recording device substrate is to be placed, is lower than or equal to 0.5 mm.

9. The method of manufacturing the liquid ejection head according to claim 1, wherein the first surface includes inclination that is lowered toward a root of the convex portion.

10. A method of manufacturing a liquid ejection head, the liquid ejection head including a recording device substrate configured to eject liquid, an electric wiring member configured to be electrically connected to the recording device substrate at an electric connection portion, and a support member including a concave portion configured to store the recording device substrate and a convex portion protruding from an inner surface of the concave portion toward the recording device substrate, the convex portion including a first surface and a second surface, the first surface being located at a position higher than a surface of the concave portion on which the recording device substrate is to be placed, and the second surface being located at a position higher than the first surface, the method comprising:

performing first application to apply an adhesive to the surface of the concave portion on which the recording device substrate is to be placed;

pressing the applied adhesive after the recording device substrate is placed on the surface of the concave portion on which the recording device substrate is to be placed, to fill, with the adhesive, a part of a gap between the convex portion and the recording device substrate facing the convex portion;

performing second application to apply an adhesive to the first surface after the pressing, to fill, with the adhesive, the gap from the surface of the concave portion on which the recording device substrate is to be placed to a position higher than the first surface; and sealing the electric connection portion of the recording device substrate and the electric wiring member, with a sealing material.

11. The method of manufacturing the liquid ejection head according to claim 10, wherein, in the second application, the gap is filled with the adhesive from the first surface to a position of ¾ or more of a distance between the first surface and the second surface.

12. The method of manufacturing the liquid ejection head according to claim 10, wherein the adhesive in the first application has a thixotropy index of 1 or less.

* * * * *